US005370232A

United States Patent [19]

Tiramani

[11] Patent Number: 5,370,232

[45] Date of Patent: * Dec. 6, 1994

[54] ORGANIZER

[75] Inventor: Paolo Tiramani, Greenwich, Conn.

[73] Assignee: 500 Group Incorporated, Greenwich, Conn.

[ * ] Notice: The portion of the term of this patent subsequent to Jun. 29, 2010 has been disclaimed.

[21] Appl. No.: 75,685

[22] Filed: Jun. 11, 1993

Related U.S. Application Data

[63] Continuation of Ser. No. 876,035, Apr. 30, 1992, Pat. No. 5,222,604.

[51] Int. Cl.[5] ..... B65D 25/28

[52] U.S. Cl. ..... 206/581; 132/314; 206/565; 220/732; 220/761

[58] Field of Search ..... 16/110 A, 110 R, 110.5, 16/126; 206/1.7, 214, 362, 369, 549, 564, 581, 823; 220/732, 735, 736, 756, 760, 761, 754, 757; 132/286, 293–295, 297, 314, 317, 318

[56] References Cited

U.S. PATENT DOCUMENTS

| | | | |
|---|---|---|---|
| 1,959,262 | 5/1934 | Colabrese | 220/732 |
| 2,019,083 | 10/1935 | Loftin | 206/373 |
| 2,087,056 | 7/1937 | Bowen | 132/297 |
| 2,525,633 | 10/1950 | Arnett | 220/757 |
| 2,566,877 | 9/1951 | Dunton | 220/736 |
| 3,583,556 | 6/1971 | Wagner | 206/373 |
| 4,319,683 | 3/1982 | Correa, III | 220/757 |
| 4,995,526 | 2/1991 | Garrison | 220/735 |
| 5,025,817 | 6/1991 | Wen | 132/297 |
| 5,107,984 | 4/1992 | Welschoff | 132/318 |

FOREIGN PATENT DOCUMENTS

| | | | |
|---|---|---|---|
| 0108072 | 8/1939 | Australia | 132/314 |

*Primary Examiner*—Jimmy G. Foster
*Attorney, Agent, or Firm*—Thomas L. Adams

[57] ABSTRACT

An organizer has a tray with a central stall. An invertable handle is mounted on the tray to swing about a handle axis between an exposed position and an inverted position. The tray has a detention device for holding the handle in the exposed position. An arched holder is pivotally mounted atop the tray to fold flat against it. This arched holder is mounted to straddle the handle.

35 Claims, 4 Drawing Sheets

ORGANIZER

This is a continuation of application, Ser. No. 07/876,035, filed Apr. 30, 1992, U.S. Pat. No. 5,222,604.

BACKGROUND OF THE INVENTION

The present invention relates to organizers, and in particular, to organizers having a handle that swings between an exposed and a stored position.

An organizer is helpful for keeping numerous small objects together and readily accessible. For example, a complement of cosmetics can include numerous small items such as eyeliner pencils, lipsticks, compacts, various bottles, brushes, elastic bands, loops, etc. Much time can be wasted locating these various items when applying makeup.

An organizer can benefit from a handle, as well as a holder specially adapted for holding various small objects. Such a handle or holder should project outwardly, but such outward projection consumes much space when the product is being shipped.

Various types of trays have been made for holding reagents, dental tools, food, lipstick, etc. Some trays are molded with a shell-like structure to give the appearance but not the reality of a solid body, in order to conserve material. See for example U.S. Pat. No. 4,573,586.

Known trays include a handle that can be mounted in the center of the tray. In U.S. Pat. No. 2,553,880 a centrally mounted handle can be snapped out of a socket and stored inside the tray to conserve space during shipment. The handle, however, is loose during shipment, requires some assembly skill, and can be lost before assembly.

U.S. Pat. No. 4,904,031 shows an earring storage device having quarter and half panels that rotate about a common axis. Those panels have an arch over them, which never swings into a storage position. This storage device therefore does not fold flat and is not made compact for shipment.

A related design patent application (U.S. Ser. No. 07/774,263, filed Oct. 10, 1991) shows the appearance of an organizer by the same applicant, but does not reveal the structural and functional details disclosed and claimed herein.

See also U.S. Pat. Nos. 1,045,135; 1,484,613, 1,704,122; 2,107,023; 2,790,547; 4,610,348; and 4,849,177, as well as U.S. Design Pat. Nos. 76,482; 142,366; and 183,165.

Accordingly, there is a need for an organizer in the form of a tray that can have a handle or a holder that enhances the use of the organizer, but which can be placed into a stored position to reduce the package bulk during shipment.

SUMMARY OF THE INVENTION

In accordance with the illustrative embodiments demonstrating features and advantages of the present invention, there is provided an organizer having a tray with a central stall. An invertable handle is mounted on the tray to swing about a handle axis between an exposed position and an inverted position. The tray has a detent means for holding the handle in the exposed position.

In a related embodiment of the same invention, an organizer also includes a tray with a central stall. A handle is mounted on top of the tray and is sized to be stored in the stall. An arched holder is pivotally mounted atop the tray to fold flat against it. This arched holder is mounted to straddle the handle.

By employing such equipment, an improved organizer is achieved. In a preferred embodiment, the organizer is a shell having pockets and dividing partitions to hold various items, such as cosmetics.

The preferred organizer has a D-shaped handle rotatably mounted in a central, handle slot. The straight leg of the D-shaped handle has a cylindrical rotor with notches. The cylindrical rotor is journalled in the slot to rotate between an upright, exposed position and an inverted position. Tabs projecting at the slot engage the notches on the cylindrical rotor to hold the handle in either the exposed or the inverted position. Thus, the handle can be shipped in the inverted, stored position and simply rotated up when in use.

In this preferred organizer, a daisy-shaped holder can stand in an upright position. Fingers or petals projecting from the daisy-shaped holder can hold various items such as elastic bands, rings, hair bands, etc. This preferred holder is rotatably mounted on bosses located at the ends of the handle slot. The holder itself can fold flat against the top of the organizer.

In the preferred embodiment, the shell has a skirt girded by a soft band to add bulk and vary the texture and color of the organizer.

BRIEF DESCRIPTION OF THE DRAWINGS

The above brief description as well as other objects, features and advantages of the present invention will be more fully appreciated by reference to the following detailed description of presently preferred, but nonetheless, illustrative embodiments in accordance with the present invention, when taken in conjunction with the accompanying drawings, wherein.

DETAILED DESCRIPTION OF THE PREFERRED EMBODIMENTS

Figure 1:
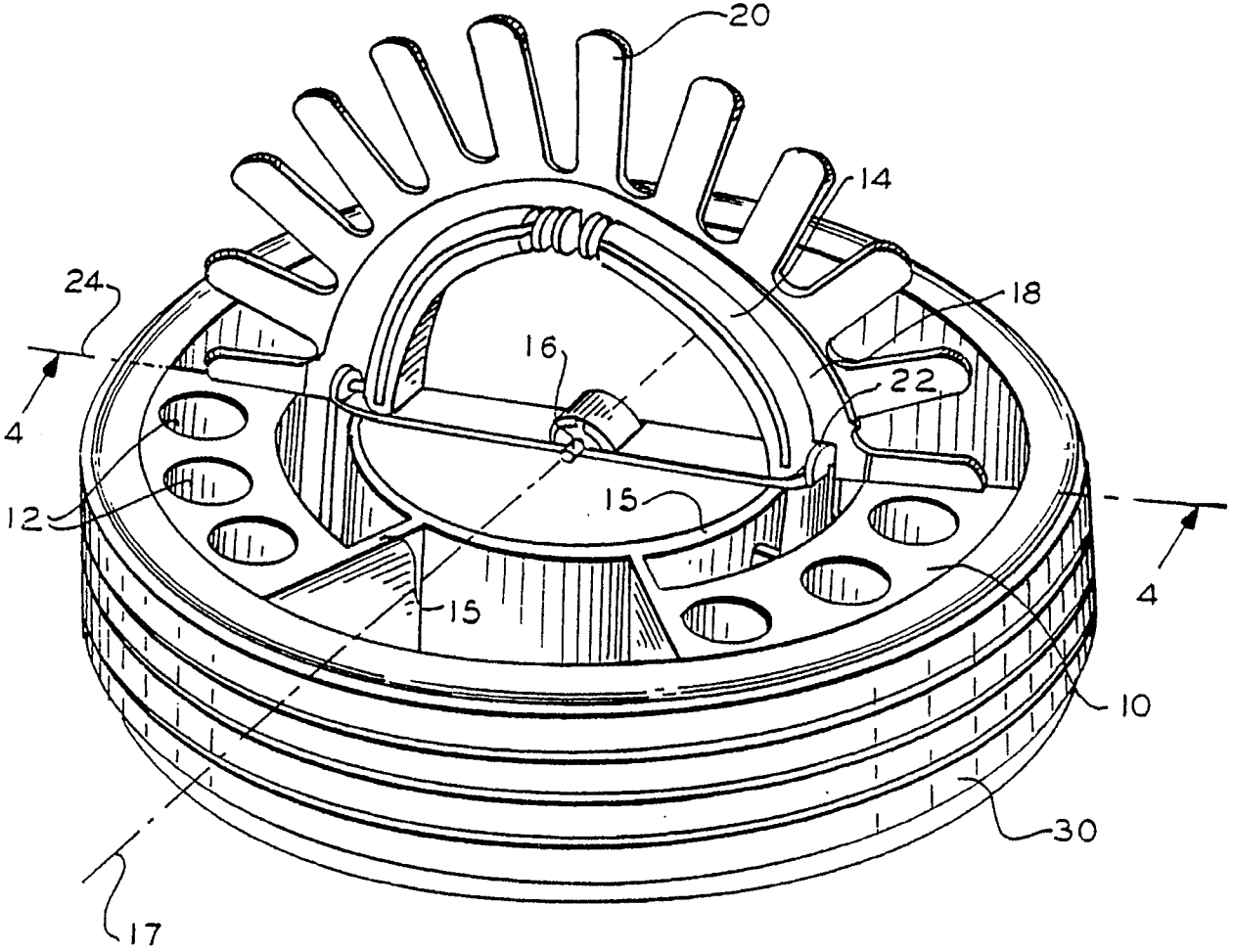
FIG. 1 is a perspective view of an organizer in accordance with the principles of the present invention.
Figure 2:
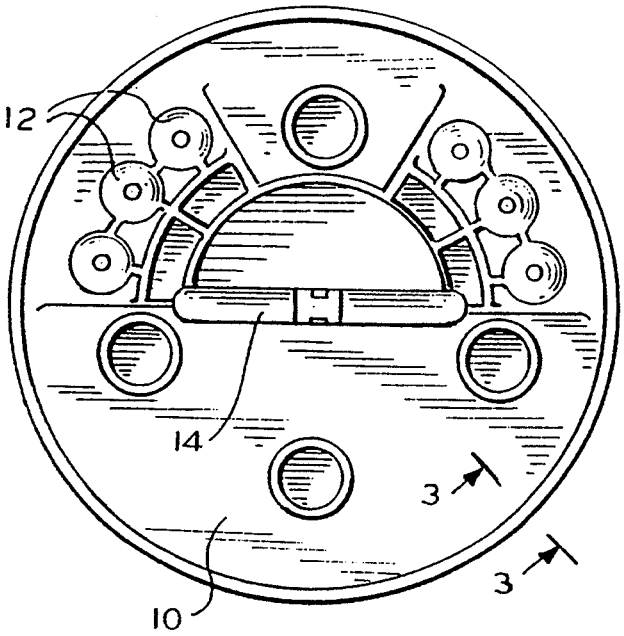
FIG. 2 is a bottom view of the organizer of FIG. 1.

Referring to FIGS. 1 and 2, an organizer is shown as a tray comprising a plastic, central shell 10, including a number of pockets 12. For example, cylindrical pockets are shown for holding cosmetics such as lipstick. The other pockets shown here have a frustro-cylindrical shape, although other shapes are possible. The tray includes dividing partitions 15 in various locations to segregate the pockets into separate compartments.

An invertable handle 14, shown as a D-shaped plastic member, has an arched portion over a finger opening. Handle 14 is rotatably mounted on trunion 16 to rotate about handle axis 17. As described further hereinafter, handle 14 rotates in a horizontal plane between an upright, exposed position to an inverted, stored position.

Figure 7:
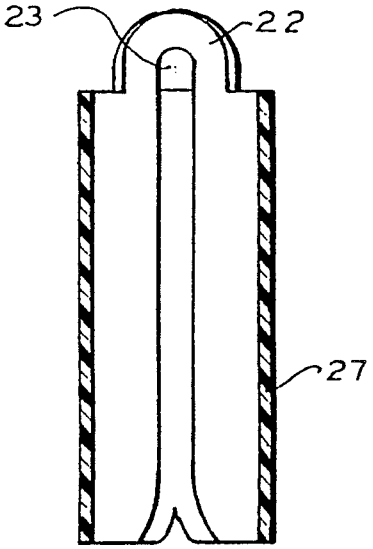
FIG. 7 is a cross-sectional view of the stall, taken along line 7—7 of FIG. 5.

Also rotatably mounted on the tray is a daisy-shaped holder 18 having twelve petals or fingers 20, although a different number can be employed instead. The fingers 20 are designed to hold annular objects such as elastic bands, rings, hair bands, etc. Holder 18 is designed to swing about holder axis 24. Holder 18 is journalled on cylindrically curved, upright bosses 22 that project upwardly from top of shell 10. FIG. 7 shows the inside of boss 22, revealing journal hole 23.

Figure 3:
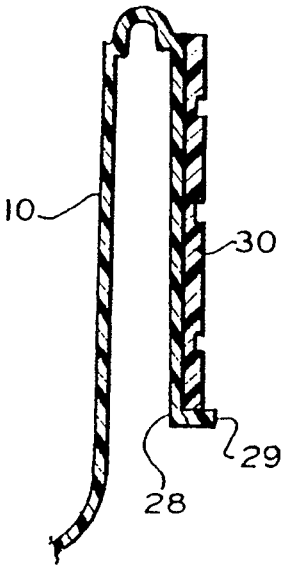
FIG. 3 is a cross-sectional view of the shell and skirt of the organizer, taken along line 3—3 of FIG. 2.

Referring to FIG. 3, the perimeter of shell 10 is shown having a dependent skirt 28 with an L-shaped cross section. The skirt 28 is girded by band 30. Band 30 can be a softer plastic that acts as a bumper and can have a different color or texture for an accent. Band 30 is installed simply by slipping it down around the skirt 28 until it rests on ledge 29 of skirt 28.

Figure 4:
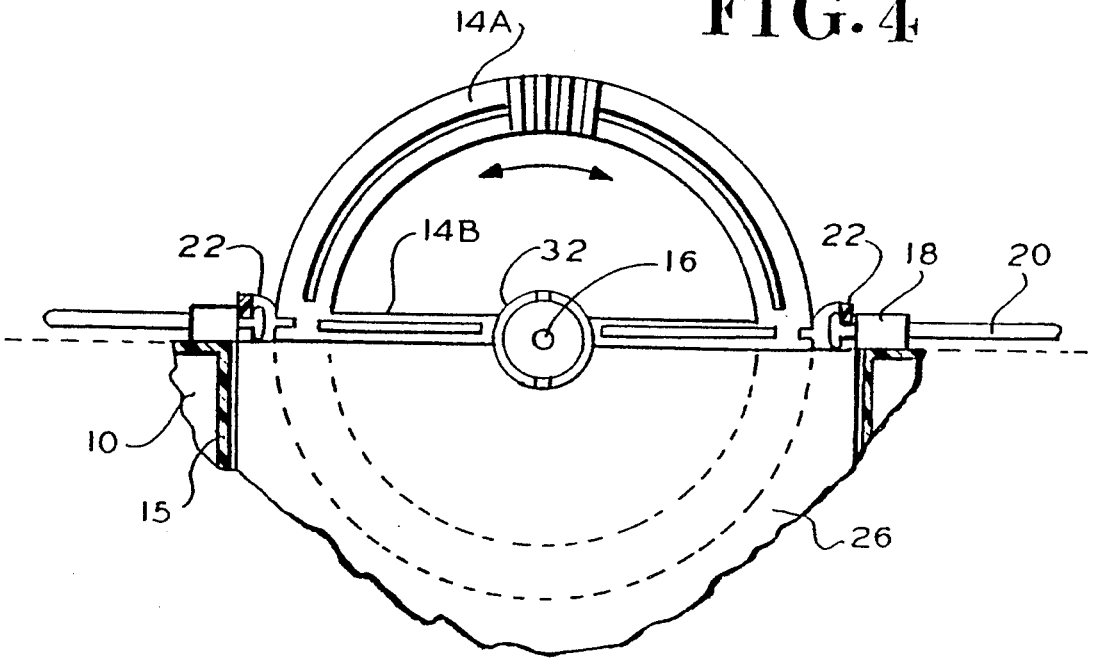
FIG. 4 is a detailed, partial, cross-sectional view taken along line 4—4 of FIG. 1.
Figure 5:
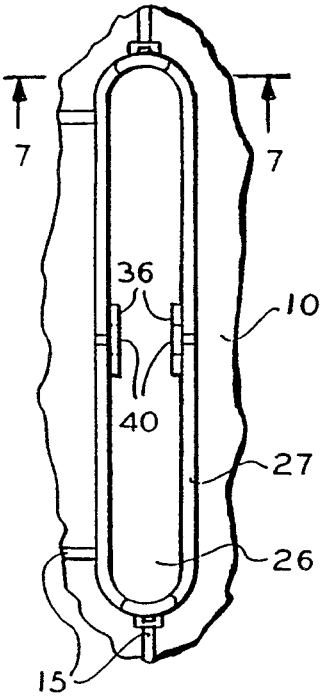
FIG. 5 is a detailed top view of the central stall and the organizer of FIG. 1, shown with the holder and handle removed.
Figure 6:
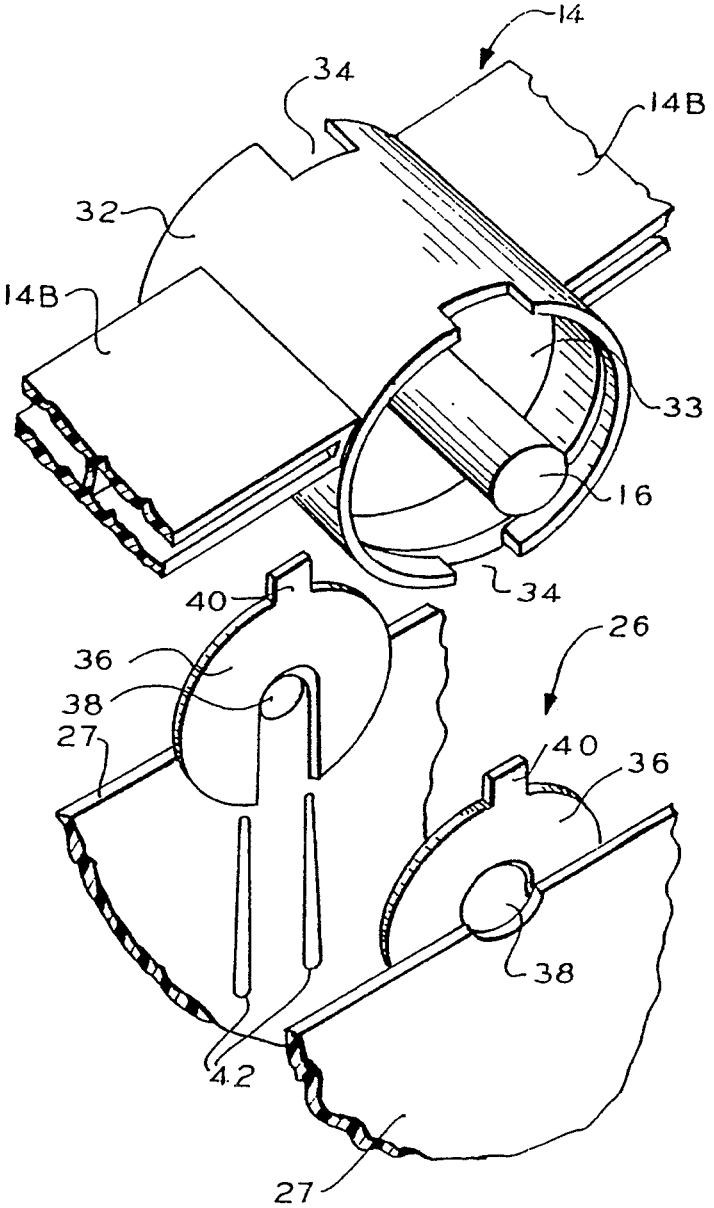
FIG. 6 is a detailed, exploded view of the rotating Joint between the handle and stall of the organizer of FIG. 1.

Referring to FIGS. 4, 5, and 6, D-shaped handle 14 is shown with an arched portion 14A connecting to a straight portion 14B. Integrally molded in straight portion 14B is cylindrical rotor 32, shown in detail in FIG. 6. Rotor 32 is generally hollow except for a central transverse wall 33. Trunions 16 project perpendicularly in opposite directions from center wall 33. Four notches 34 are molded as indicated on the periphery of rotor 32.

Stall 26 is a slot-shaped opening whose upper portion is bordered by oval wall 27. Stall 26 is open from above and below. Stall 26 has a disk-like embossment 36 concentrically embracing a pair of opposing holes 38. Disks 36 have an upright tab 40 operating as a detent means. As described hereinafter, this detent means can hold handle 14 in either an exposed or in a stored, inverted position.

Disks 36 also have lower radial slots, giving the disks a C-shape. Aligned with the radial slot of disk 36 are a pair of rails 42 embossed into the inside surface of wall 27. Rails 42 and the slots in disks 36 form a track for guiding trunions 36 into holes 38 during assembly. Handle 14 is installed by thrusting it up into stall 26 from below, so that disks 36 as well as rails 42 guide trunions 16 into holes 18.

Figure 8:
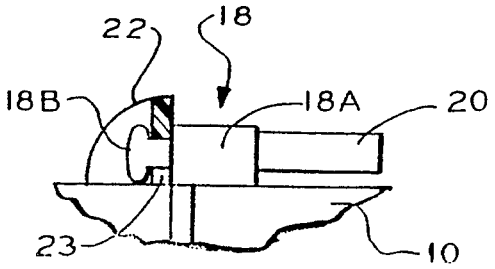
FIG. 8 is a detailed view of the rotating joint between the holder and boss of FIG. 4.
Figure 9:
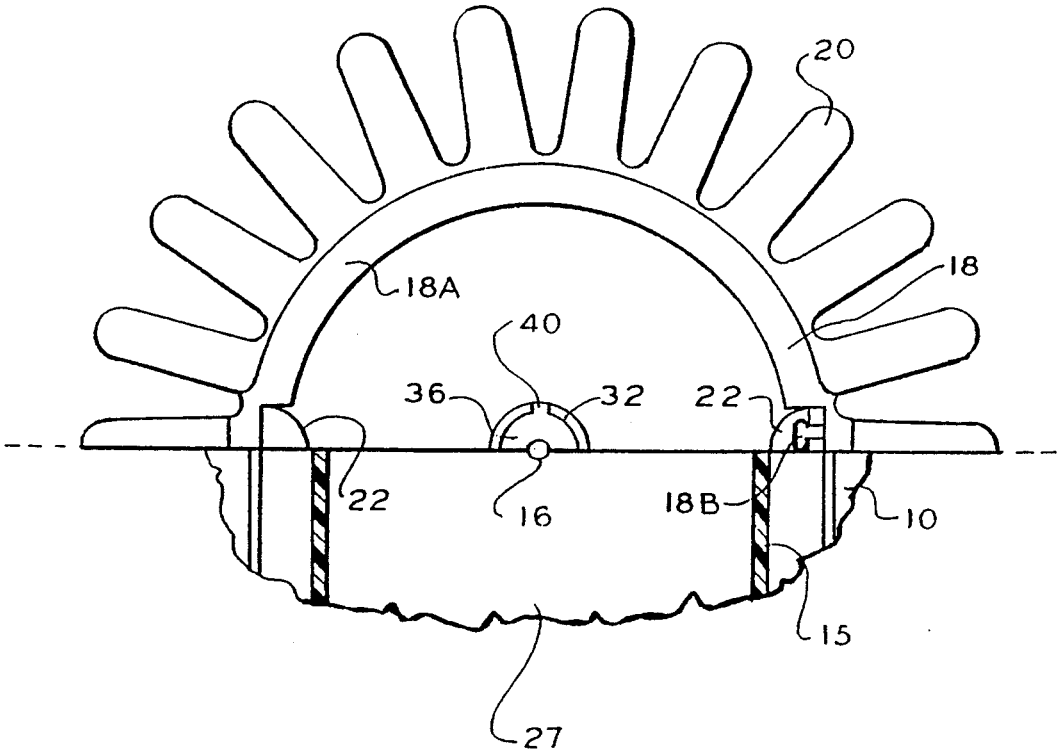
FIG. 9 is a modified view of the structure of FIG. 4 (the left boss is not sectioned in this view), but with the holder swung into an upright position and the handle swung into the inverted, stored position.

Referring to FIGS. 4, 5, 7, 8 and 9, holder 18 is shown as a daisy-shaped arch, with radially projecting petals or fingers 20. Holder 18 has a trunion 18B (FIG. 8) mounted in hole in previously mentioned boss 22. The holder is removed in this view for simplicity and clarity. The end of trunion 18B is peened into the shape shown with an appropriate heating tool. Holder 18 is generally flat but has a thickened, arching, rectangular base 18A, having flat sides and a flat bottom. As shown in FIG. 8, a flat side of base 18A is folded against the top side of shell 10. Consequently, holder 18 will be held in a folded or stored position. Holder 18 can also be rotated into an upright position at which time the flat bottom of base 18A snaps into place as shown in FIG. 9 to keep holder 18 upright.

To facilitate an understanding of the principles associated with the foregoing apparatus, its operation will be briefly described. The tray can be fabricated by molding shell 10 in the form shown in FIG. 1. Thereafter band 30 can be slipped over skirt 28 (FIG. 3). Next handle 14 can be pressed upwardly through stall 26 guided by tracks 42 (FIG. 6) and the slots in disks 36, so that trunions 26 pop into holes 38. Holder 18 can be installed by inserting its trunion 18B into the holes 23 (FIG. 7) in boss 22. Trunions 18B can then be heated and peened as shown in FIG. 9.

Once assembled, the tray can be configured in a stored condition by rotating handle 14 from the position shown in FIG. 4 into the stored position indicated in phantom. When in the stored position, the handle is hidden as shown in FIG. 9. Holder 18 can be rotated from the upright position of FIG. 9 to the flat, folded position shown in FIG. 4. In doing so, the flat bottom of arched base 18A rotates away from the top of shell 10. When thus configured, the top of the organizer has essentially no significant projections.

The user can move the handle and holder into the upright position as follows: the handle can be rotated about trunion 16 until it reaches the upright position, at which point, tabs 40 (FIG. 6 and 9) snap into the notches 34 of rotor 32. Next, holder 18 can be rotated into an upright position, wherein the flat underside of arched base 18A rests against the top side of the shell 10, keeping holder 18 in an upright position.

The outside curve of handle 14 matches the inside curve of the holder 18, so they conform. This feature allows for an efficient and compact operation for handle 14 and holder 18.

The user can now place various objects, such as various cosmetic items in the pockets and compartments in shell 10. Lipsticks can be conveniently placed in the cylindrical pockets in shell 10. Furthermore, the user can place hair bands, elastic bands, rings, and other objects on the fingers 20 of holder 18.

The organizer can be carried by grasping handle 14. In some instances, holder 18 can be folded down to take the items stored on the holder out of the way of handle 14. This makes the organizer more compact, to make the handle 14 more accessible, and carrying easier.

It is to be appreciated that various modifications may be implemented with respect to the above described preferred embodiments. For example the size, arrangement, and shape of the various pockets, compartments and dividing partitions of the tray can be altered depending upon the objects to be stored. Also, while the tray is shown as having a circular plan, in other embodiments, the plan can be oval, rectangular, polygonal, etc. In other embodiments, the handle need not be D-shaped but can be rectangular, polygonal, etc. While a handle detainer is shown here as a tab and notch, in other embodiments, different detainers can be used, such as ball and sockets, friction fitting, splines, etc. Similar detention means can be used to keep the holder in desired positions. In some embodiments the holder may not have fingers or petals as illustrated, but may include hooks, fasteners, or a more simplified structure by which objects can be attached or hung. Also, the organizer can be made of various types of plastics, metals or other materials, depending upon the desired strength, weight, reliability, rigidity, etc.

Obviously, many modifications and variations of the present invention are possible in light of the above teachings. It is therefore to be understood that within the scope of the appended claims, the invention may be practiced otherwise than as specifically described.

I claim:

1. An organizer comprising:

a tray having a plurality of upwardly open pockets, said tray comprising a central shell of substantially uniform thickness having at least one pocket formed therein, said shell having mounted atop it at least one upright partition;

a movable handle mounted on said tray to reciprocate in a direction along an upright plane between an extended position and a stored position; and a bumper encircling said tray.

2. An organizer according to claim 1 wherein said bumper is more resilient than said tray.

3. An organizer according to claim 2 wherein said bumper is made of a softer material than said tray.

4. An organizer according to claim 1 wherein said bumper is discrete from said tray.

5. An organizer according to claim 1 wherein said bumper is ribbed longitudinally.

6. An organizer according to claim 1 wherein said organizer has an encompassing upper border and wherein said handle is spaced inwardly from said upper border and is mounted centrally atop said tray.

7. An organizer according to claim 1 wherein said handle has an arched portion defining a finger opening.

8. An organizer according to claim 7 wherein said arched portion follows a circular arc.

9. An organizer according to claim 1 further comprising:

a holder pivotally mounted atop said tray to fold down against it.

10. An organizer according to claim 9 wherein said holder has a spaced plurality of projections.

11. An organizer according to claim 10 wherein said tray comprises:

a central shell of substantially uniform thickness having at least one pocket formed therein, said shell having mounted atop it at least one upright partition.

12. An organizer according to claim 11 wherein said tray is sized to hold facial cosmetics.

13. An organizer according to claim 12 wherein said pocket is sized to hold a lipstick.

14. An organizer according to claim 11 wherein said organizer has an encompassing upper border and wherein said handle is spaced inwardly from said upper border and is mounted centrally atop said tray.

15. An organizer according to claim 11 wherein said handle has an arched portion defining a finger opening.

16. An organizer according to claim 15 wherein said arched portion follows a circular arc.

17. An organizer comprising:

a tray having a plurality of upwardly open pockets;

a handle mounted atop said tray; and a serrated member pivotally mounted atop said tray to fold against it in either one of two directions from vertical.

18. An organizer according to claim 17 wherein said serrated member has a spaced plurality of projections.

19. An organizer according to claim 18 wherein said tray comprises:

a central shell of substantially uniform thickness having at least one pocket formed therein, said shell having mounted atop it at least one upright partition.

20. An organizer according to claim 19 wherein said tray is sized to hold facial cosmetics.

21. An organizer according to claim 20 wherein said pocket is sized to hold a lipstick.

22. An organizer according to claim 19 wherein said organizer has an encompassing upper border and wherein said handle is spaced inwardly from said upper border and is mounted centrally atop said tray.

23. An organizer according to claim 22 wherein said handle has an arched portion defining a finger opening.

24. An organizer according to claim 23 wherein said arched portion follows a circular arc.

25. An organizer comprising:

a tray having a plurality of upwardly open pockets;

a movable handle mounted on said tray to reciprocate in a direction along an upright plane between an extended position and a stored position, said handle having an arched portion following a circular arc and defining a finger opening; and a bumper encircling said tray.

26. An organizer according to claim 25 wherein said bumper is more resilient than said tray.

27. An organizer according to claim 26 wherein said bumper is made of a softer material than said tray.

28. An organizer according to claim 25 wherein said bumper is discrete from said tray.

29. An organizer according to claim 25 wherein said bumper is ribbed longitudinally.

30. An organizer according to claim 25 wherein said organizer has an encompassing upper border and wherein said handle is spaced inwardly from said upper border and is mounted centrally atop said tray.

31. An organizer according to claim 25 further comprising:

a holder pivotally mounted atop said tray to fold down against it.

32. An organizer according to claim 31 wherein said holder has a spaced plurality of projections.

33. An organizer according to claim 32 wherein said tray is sized to hold facial cosmetics.

34. An organizer according to claim 33 wherein said pocket is sized to hold a lipstick.

35. An organizer according to claim 34 wherein said organizer has an encompassing upper border and wherein said handle is spaced inwardly from said upper border and is mounted centrally atop said tray.

* * * * *